United States Patent [19]

Turchi et al.

[11] Patent Number: 4,946,106

[45] Date of Patent: Aug. 7, 1990

[54] ELECTROMAGNETICALLY-CONTROLLED FUEL INJECTION VALVE FOR DIESEL ENGINES

[75] Inventors: Sergio Turchi, Rivalta; Alessandro Valetto, Turin, both of Italy

[73] Assignee: Weber S.r.l., Turin, Italy

[21] Appl. No.: 236,468

[22] Filed: Aug. 25, 1988

[30] Foreign Application Priority Data

Aug. 25, 1987 [IT] Italy ..... 53611/87[U]

[51] Int. Cl.[5] ..... B05B 1/30

[52] U.S. Cl. ..... 239/585; 239/96; 239/533.3; 239/533.8; 123/458; 123/459

[58] Field of Search ..... 239/585, 96, 533.6, 239/533.8, 533.2, 533.9; 251/30.01, 30.05; 123/458, 459

[56] References Cited

U.S. PATENT DOCUMENTS

| | | | |
|---|---|---|---|
| 2,075,949 | 4/1957 | Lemon | 239/96 |
| 3,464,627 | 9/1969 | Huber | 239/96 |
| 3,511,443 | 5/1970 | Gliken et al. | 239/533.6 |
| 4,164,326 | 8/1979 | Deckard | 239/585 |
| 4,482,094 | 11/1984 | Knape | 239/88 |
| 4,566,416 | 1/1986 | Berchtold | 239/533.8 |
| 4,584,980 | 4/1986 | Weiger et al. | 251/129.06 |
| 4,605,166 | 8/1986 | Kelly | 239/96 |
| 4,628,881 | 12/1986 | Beck et al. | 239/96 |

FOREIGN PATENT DOCUMENTS

| | | |
|---|---|---|
| 0196265 | 10/1986 | European Pat. Off. . |
| 0228578 | 7/1987 | European Pat. Off. . |
| 2252769 | 5/1973 | Fed. Rep. of Germany . |
| 3227742 | 5/1983 | Fed. Rep. of Germany . |
| 2190167 | 1/1974 | France . |
| 82/03108 | 9/1982 | PCT Int'l Appl. . |
| 494346 | 7/1970 | Switzerland . |
| 2185530 | 7/1987 | United Kingdom . |

*Primary Examiner*—Andres Kashnikow
*Assistant Examiner*—Christopher G. Trainor

[57] ABSTRACT

An electromagnetically-controlled fuel injection valve for diesel engines includes a body having an upper electromagnetic metering valve which controls communication between a control chamber supplied with the pressurized fuel and a discharge port. The metering solenoid valve, which itself constitutes a unit independent of the rest of the injection valve, is supported by a head element connected to the body of the injection valve by axial clamping means and has an appendage which carries the control chamber and the discharge port and is inserted in an axial seat in the body with the interposition of double sealing means.

8 Claims, 1 Drawing Sheet

ELECTROMAGNETICALLY-CONTROLLED FUEL INJECTION VALVE FOR DIESEL ENGINES

The present invention relates in general to electromagnetically-controlled fuel injection valves for diesel engines.

More particularly, the invention relates to an injection valve of the type comprising a body having a lower injection nozzle with which is operatively associated a needle controlling communication between the nozzle and an injection chamber which communicates with a passage for the supply of fuel under pressure, and an upper electromagnetic metering valve which controls the communication between a control chamber, to which the fuel is supplied under pressure through an inlet port to maintain the needle in the closed position, and a discharge port the opening of which causes a pressure drop in the control chamber and the consequent opening of the needle.

The injection valve according to the invention is characterised in that the metering solenoid valve is constituted by a unit structurally and functionally independent of the rest of the injection valve and is supported by a head element connected to the body of the injection valve by axial clamping means and has an appendage inserted in an axial seat in the body in communication with the inlet port, the appendage forming the control chamber and the discharge port and double terminal sealing means being interposed between the appendage and the seat in the body.

By virtue of this characteristic, the metering solenoid valve with the control chamber and the discharge port constitutes an autonomous unit which can be subjected in a convenient and easy manner to the operations necessary for the calibration of the discharge port and calibration and setting up of the metering solenoid valve, before the assembly of the injection valve. In other words, the metering solenoid valve—discharge port—control chamber unit may to advantage be tested independently, with obvious practical advantages.

Preferably, the double sealing means include complementary frontal conical sealing surfaces between the body and the head element, and an annular resilient member coaxial with the appendage.

According to another aspect of the invention, the appendage has an associated variable-thickness block for limiting the opening travel of the needle.

According to another characteristic of the invention, the needle may have two different diameters in correspondence with its portion on which the pressure in the control chamber acts and its portion on which the pressure in the injection chamber acts.

According to another aspect, the second passage for the supply of fuel to the injection chamber includes a ring of apertures formed in the body around the needle.

The needle may be a single piece or, alternatively, two pieces.

Figure 1:
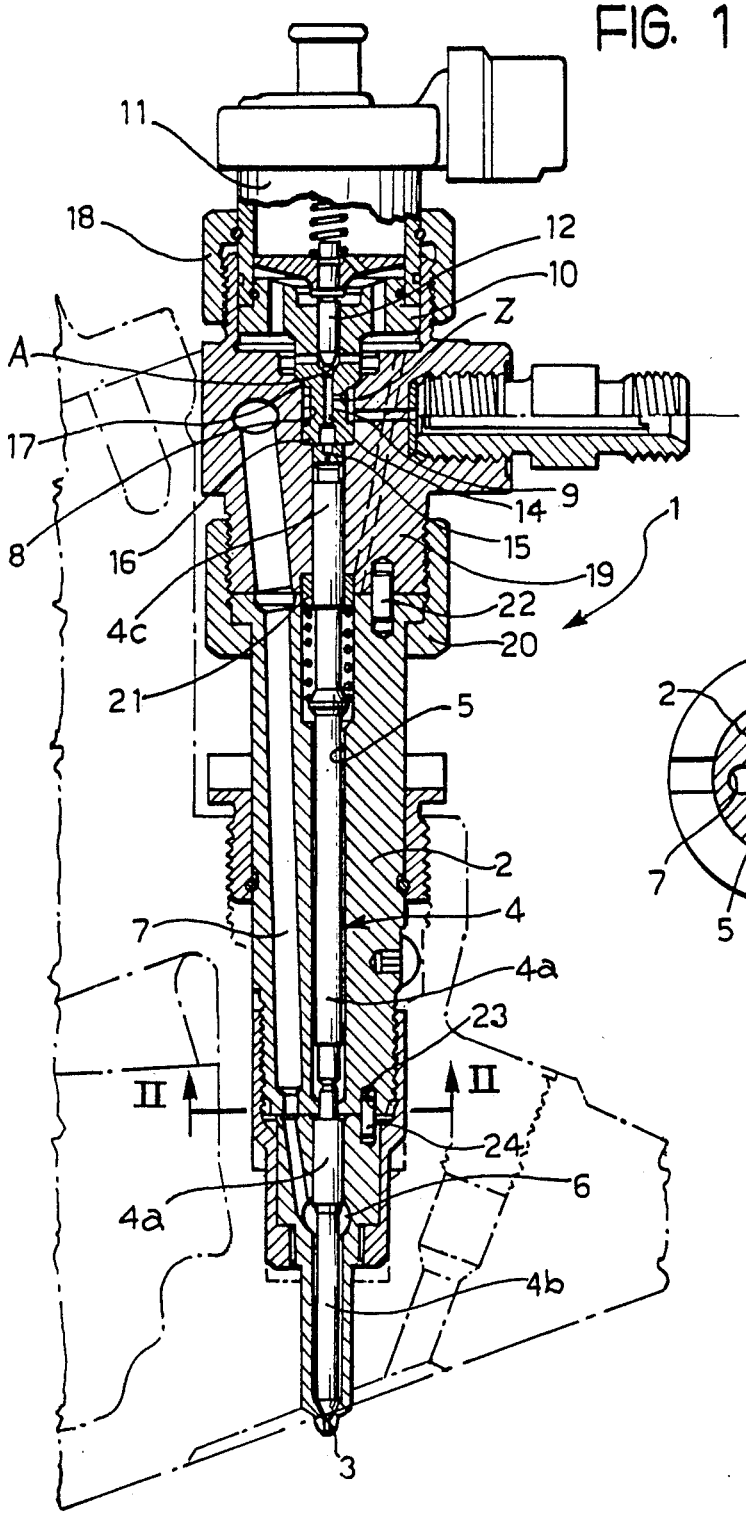
Figure 2:
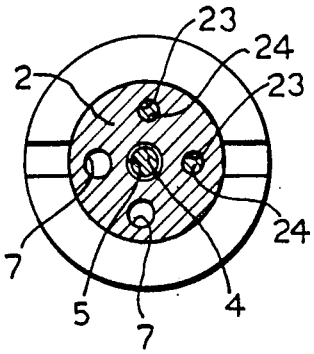

Further characteristics of the invention will become apparent during the detailed description which follows with reference to the appended drawings, provided purely by way of non-limiting example, in which:

FIG. 1 is a schematic longitudinal sectional view of an injection valve according to the invention, and FIG. 2 is a cross-sectional view taken on the line II—II of FIG. 1.

With reference to the drawings, a fuel injection valve for diesel engines is schematically and generally indicated 1. The valve 1 comprises essentially a body 2 forming a lower injection nozzle 3 the opening and closing of which is controlled by a needle 4 movable axially within a central cavity 5 in the body 2. The lower zone of this cavity 5 forms an injection chamber 6 into which the fuel is directed under pressure by a pump, not illustrated, through supply passages 7 formed in the body 2. As is seen in FIG. 2, two supply panels 7 and two smaller-diameter apertures 23 for the engagement of centering stops 24 are provided.

The upper end of the cavity 5 defines a seat 8 to which the fuel is also supplied under pressure through an inlet port Z. An axial appendage 9 is engaged in this seat 8 and is integral with an element 10 applied in the form of a head to the top of the body 2 and carrying a metering solenoid valve 11. The obturator of the solenoid valve 11, indicated 12, cooperates with a fuel discharge port A formed in the upper part of the appendage 9 and communicating with a control chamber 14 also formed in this appendage 9. The control chamber 14 communicates with a cavity 5 through a variable-thickness block 15 for limiting the opening travel of the needle 4. In the embodiment illustrated, this needle 4 is formed by two axial portions 4*a*, 4*b*: it should be noted, however, that it could alternatively be formed in a single piece. In both cases, the region of the needle 4 which faces the control chamber 14, indicated 4*c*, conveniently has a diameter which is different from, normally larger than, that of its portion 4*b* on which the fuel pressure in the thrust chamber 6 acts. The top of needle 4 is spaced below block 15 in the closed position of needle 4 by a spring in central cavity 5 which biases the needle 4 downwardly to close the lower injection nozzle 3.

The control chamber 14 is in communication with the seat 8 and hence with the inlet port Z. In order to isolate this control chamber 14 hermetically from the fuel discharge downstream of the discharge port A, a double seal is provided between the appendage 9 and the ends of the seat 8, formed in the lower part by a resilient annular washer 16 and in the upper part by complementary frontal conical sealing surfaces 17. Alternatively, these frontal sealing surfaces 17 could be replaced by an annular washer similar to the washer 16.

In the embodiment illustrated, the head element 10 is fixed to the body by means of a ring nut 18. In addition or alternatively to this ring nut 18, the head element 10 may be clamped to the body 2 by means of a threaded coupling between the appendage 9 and the seat 8.

In the embodiment illustrated, the head element 10 is not in effect fixed directly to the body 2 but is connected thereto by an intermediate member 19 which is fixed to the body 2 in its turn by means of a ring nut 20 and by means of a centering system including a bush 21 surrounding the needle 4 and an eccentric reference pin 22.

The operation of the injection valve 1 is generally known: in the condition in which the discharge port A is closed by the obturator 12 of the solenoid valve 11, the needle 4 is kept in the lowered position to close the injection nozzle 3 and prevent the escape of pressurised fuel in the injection chamber 6. As soon as the discharge port A is opened, the consequent drop in pressure in the control chamber 14 enables the needle 4 to rise against the action of the pressure in the chamber 6, enabling the injection of fuel through the nozzle 3. The configuration of the needle 4, with its regions 4*c*, 4*b* of different diameters, enables the force applied to the needle 4 to be varied in this phase, while the presence of the supply apertures 7 enables the accumulated volume of pressurised fuel to be increased, larger passage sections being provided.

The integration of the solenoid valve 11 with the discharge port A and the control chamber 14 in the head element 10 enables the pressure modulation and the rate of flow through the discharge port A to be checked separately and independently, before the assembly of the valve 1. This enables the necessary calibration and setting up of the entire pressure control system upstream of the needle 4 to be carried out more easily.

We claim:

1. An electromagnetic-controlled fuel injection valve for diesel engines, comprising:

a body (2) defining an axially extending cavity (5) with an upper end, a lower injection nozzle (3) and an injection chamber (6) between said upper end and said nozzle, said body including a fuel supply passage (7) extending from a location near said upper end of said cavity, to said injection chamber for supplying fuel to said injection chamber, said body defining a seat (8) communicating with said upper end of said cavity, and an upper opening communicating with said seat on a side of said seat opposite from said cavity, said body also including a fuel supply conduit communicating with said seat and a fuel discharge conduit communicating with said upper opening;

a needle (4) mounted for axial movement in said cavity and through said injection chamber for opening and closing said lower injection nozzle;

means for biasing said needle toward said injection nozzle;

a structurally and functionally independently testable electromagnetic metering valve unit (11) detachably connected to said body, said unit comprising a head element (10) engaged in said upper opening of said body, said head element having an appendage (9) extending into said seat (8) with sealing means (16, 17) for sealing opposite ends of said appendage to opposite ends of said seat for isolating said fuel supply conduit from said fuel discharge conduit, said appendage having an inlet port (Z) communicating with said seat and an outlet (A) communicating with said upper opening, said appendage including a control chamber (14) therein communicating with the upper end of said cavity, a valve passage extending through said head and said appendage, said valve passage communicating with said control chamber, said inlet port and said outlet port, said unit including an obturator (12) electromagnetically movable in said valve passage for opening and closing communication between said control chamber and said outlet port;

block means (15) in said upper end of said cavity for separating said control chamber from an upper end of said needle and for defining the upper end of a stroke of movement of said needle in said cavity; and axial clamping means (18) for detachably and axially clamping said unit to said body so that said unit with said head and appendage can be detached from said body without disturbing said fuel supply conduit and without disturbing said fuel discharge conduit.

2. A valve according to claim 1, wherein said sealing means (16, 17) comprise mating conical sealing surfaces (17) on an upper end of said seat (8) and on an upper end of said appendage (9) for sealing the upper end of the appendage to the upper end of the seat, and an annular resilient member (16) at a lower end of said appendage for sealing against a lower end of said seat.

3. A valve according to claim 1, wherein said block means comprises a variable thickness block for limiting the upper end of travel of the needle by a variable amount.

4. A valve according to claim 3 wherein said needle includes a large diameter upper portion (**4*c*) ending near the top of said injection chamber (6) and a small diameter lower portion (4*b***) beginning at the top of said injection chamber and connected to said large diameter upper portion.

5. A valve according to claim 2, wherein the fuel supply passage to the injection chamber (6) includes a plurality of apertures (7) formed in the body (2) around the needle (4).

6. A valve according to claim 2, wherein the needle (4) is a single piece.

7. A valve according to claim 2, wherein the needle (4) is in two pieces (**4*a*, 4*b***).

8. A valve according to claim 2, wherein an intermediate element (19) is provided between the head element (10) and the body (2) of the injection valve (1) and has members for centering it relative to the body (2) including a bush (21) surrounding the needle (4) and an eccentric pin (22).

* * * * *